United States Patent [19]

Jordon

[11] 4,194,316

[45] Mar. 25, 1980

[54] SELF BALANCING DIABOLO TOP WITH ATTACHMENT FOR VERTICAL SPINNING

[76] Inventor: Walter L. Jordon, 10443 SW. 185 Ter., Miami, Fla. 33157

[21] Appl. No.: 936,934

[22] Filed: Aug. 25, 1978

[51] Int. Cl.[2] ..... A63H 27/12

[52] U.S. Cl. ..... 46/60; 46/73

[58] Field of Search ..... 46/60, 73

[56] References Cited

U.S. PATENT DOCUMENTS 2,891,351 6/1959 Madaras et al. ..... 46/73

FOREIGN PATENT DOCUMENTS 908994 9/1972 Canada ..... 46/60

*Primary Examiner*—Houston S. Bell, Jr.

*Attorney, Agent, or Firm*—Erwin M. Barnett

[57] ABSTRACT

A diabolo top comprises bowl-shaped halves of molded plastic, each half having a central hub formed with an axial opening and coacting aligning pin means. A threaded bolt, extending through the axial openings, mounts a nut and retains the hubs in face-to-face abutment as a bottom of a deep annular groove formed by and between convex wall surfaces of the halves. The conventional string, manipulated at opposite ends thereof to spin the top on a horizontal axis, engages the deep annular groove and coacts with the convex wall surfaces for balancing the top thereon preparatory to spinning. The aligning pin means, which include pins terminating in tapered ends, coact with flexible webs engaging the bolt and nut to facilitate flexure of a portion of the hubs away from each other on impact of the peripheral rims of the halves to avoid breakage. A ground engaging support bracket is removably attachable to the hubs by the axial bolt and nut as a means for converting the diabolo to a ground supported vertical axis spinning top. The spinner attaches to a string as a Yo-Yo and the halves, when disassembled, may be used as frisbees.

11 Claims, 7 Drawing Figures

SELF BALANCING DIABOLO TOP WITH ATTACHMENT FOR VERTICAL SPINNING

BACKGROUND OF THE INVENTION

1. Field of the Invention

The invention relates generally to a diabolo top construction and more particularly to molded plastic bowl-shaped bodies assembled in pairs in face-to-face relation as such diabolo tops, to the contouring and proportioning of the bowl-shaped bodies for self balancing on the manipulating string, to flexing features for resisting breakage, and to a conversion capability from a horizontally spinning aerial diabolo to a vertically spinning ground supported top.

2. Description of the Prior Art

All tops of the diabolo type of the prior art as well as those embodying the invention are basically similar in comprising a string, on the order of three feet in length, connected at opposite ends to a pair of sticks serving as handles, one to be held in each hand in substantially parallel relation to each other, and a spinner, that is, the top, per se, which is balanced on the string and caused to spin on its horizontal axis by manipulation of the handles. The designs and constructions of the spinners vary considerably, the spinning causing some to light up and others to produce humming and musical sounds.

The word diabolo, which etymologically is derived from a foreign language base meaning devil, appropriately describes the difficulty one has had in initially balancing such tops of prior construction on the string while attempting to bring the top from a state of rest to rotation on its horizontal axis at a speed sufficient for the gyroscopic force to maintain the top in balance on the string facilitating further manipulation and play. The marketing success of a so called "skill toy" that is, a toy requiring the development of various skills and coordination on the part of the child in order to realize any pleasure therefrom, appears to be related to the child's satisfaction with the toy at purchase so as to hold his interest and motivate continued attempts to perform with the toy. As an example, consider the child purchasing a Yo-Yo. He immediately has the Yo-Yo going up and down on the string, perhaps awkwardly, but he can do something with it. This something provides the required satisfaction at purchase and motivates the child to continue practicing and thereby achieving, step by step, higher levels of skill to hold his interest to an even greater degree. His friends, seeing him enjoy the Yo-Yo, want to buy one and do the same. In this manner, the demand for the toy is maintained along with its popularity.

It is believed that attempts in recent years at marketing diabolo type tops have completely failed or their success fallen far below expectation because of this inherent difficulty in balancing the top on the string, which translates to a serious lack of satisfaction at purchase. To be successful, therefore, there is a need to provide this satisfaction at purchase which can be accomplished by "removing the devil from the diabolo", namely by facilitating the initial balancing of the top on the string.

SUMMARY OF THE INVENTION

Among the objects of the invention is to provide spinners, that is, diabolo tops, which are relatively inexpensive to manufacture in quantity production by injection molding of a rugged yet light weight thermoplastic resin as halves, which may be identical, for easy assembly with an axial bolt and nut. Such molded plastic tops shall each incorporate a self balancing capability to meet the need for the hereinbefore mentioned satisfaction at purchase, shall resist breakage after repeatedly falling on hard paved surfaces from heights occasioned by the intended use thereof, and shall have a removable support bracket attachment for converting the spinner to a vertical spinning top.

The invention features a diabolo spinner construction which will balance when at rest on the string held in a starting position, that is, with ends of the string spaced to dispose the string in a generally V-shaped configuration held relatively taut by the weight of the spinner. The spinner, being of an axial length exceeded by the overall diameter, comprises bowl-shaped halves smooth convex exterior wall surfaces defining a medial, relatively deep annular groove between the halves for engaging the string therein. When the spinner is in starting position, the string loops under the bottom of the annular groove with the opposite string portions extending upwardly from the bottom loop being cradled between the convex exterior wall surfaces of the halves. These wall surfaces form the sidewalls of the annular groove which, by the convex configuration thereof, are located in relatively close proximity to each other along a substantial radial distance from the bottom of the groove and serve to limit the angle of tilt of the spinner thereby preventing the latter from falling off the string even though at rest or otherwise lacking the gyroscopic balancing force provided by rotation thereof on the horizontally disposed axis.

The invention also comtemplates that the spinner comprise two individually molded plastic bowl-shaped halves having relatively thin walls formed to extend between thickened peripheral rims and thickened hubs. The hubs are adapted to be assembled on an axial bolt have interengaging integral pin means preventing relative rotation of the halves on the bolt. Each hub has a flat surface for face-to-face abutment when in assembly and a circular peripheral edge coacting with that of the abutting hub as a bottom of the medial groove. The cross-sectional configuration of a portion of each hub surrounding the center opening through which the axial bolt extends provides a relatively thin flexible annular web which in assembly is contacted by the head of the bolt or the nut. These webs act to minimize breakage by providing flexibility which coact with that of the walls of the halves and aid in absorbing the shock of impact by permitting separation of the hubs along that portion thereof adjacent to the points along the rims striking the ground when the spinner is dropped or falls during play. The integral pin means comprise pins extending parallel to the axial bolt from the abutment surface of one hub through registering openings in the adjacent hub and are formed with tapered ends for facilitating the above described hub separation and realignment of the hubs into abutment relation after impact of the rims on the ground to immediately reestablish a closed bottom for the medial groove.

The axial bolt and nut removably attaches a support bracket having a stem extending beyond the rim of one of the halves and shaped to locate a rounded tip thereof at the axial center on which tip the spinner may be ground supported for vertical axial spinning as a conventional top.

DESCRIPTION OF THE PREFERRED EMBODIMENTS

Figure 1:
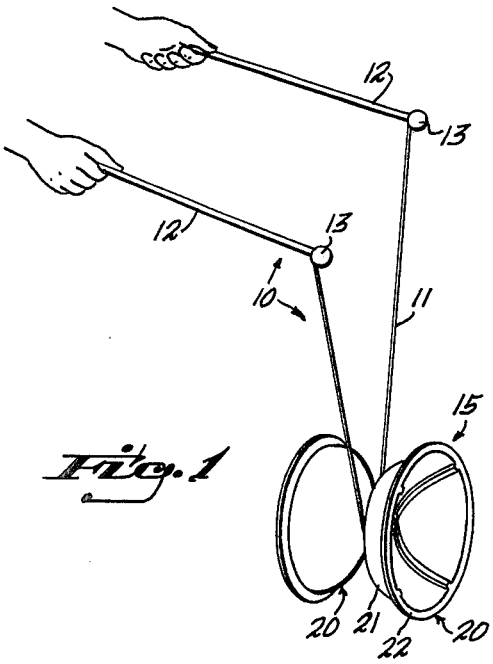
FIG. 1 is a perspective view of the spinner, embodying the invention, shown balanced on the string with the handles held in position preparatory to manipulating the string for initiating the spinning.

Referring in detail to the drawing, 10 generally denotes the diabolo toy seen in FIG. 1 to comprise a length of string 11, a pair of sticks, serving as handles 12, each of which is suitably connected adjacent one end thereof to an opposite end of string 11, and a spinner 15. The end of each handle 12, extending beyong the string attachment, may be blunted as a safety measure by a soft rubber ball 13 mounted thereon.

Figure 2:
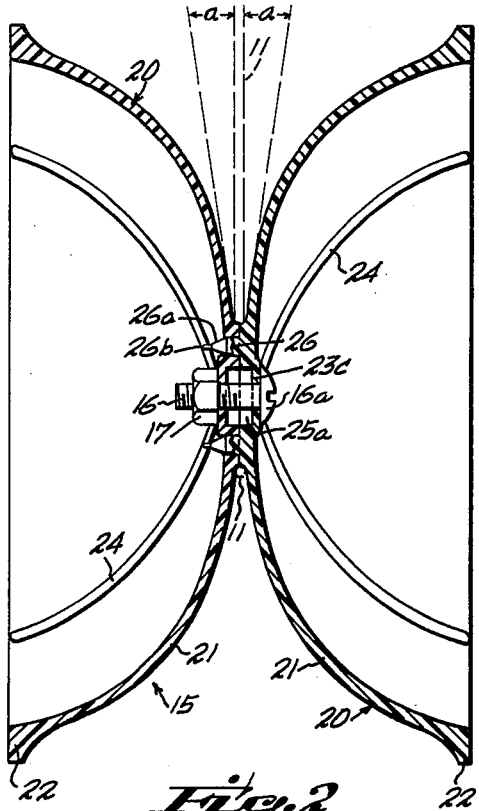
FIG. 2 is an enlarged vertical sectional view taken through the horizontal axis of the spinner shown in FIG. 1.
Figure 5:
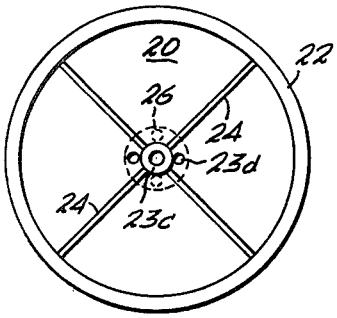
FIG. 5 is a view looking into a bowl-shaped half of the spinner shown in FIG. 1 prior to assembly.

Spinner 15, also referred to as the diabolo top, is seen in FIG. 2 to comprise identical bowl-shaped halves 20 interconnected by an axially extending and removable threaded bolt 16 and nut 17. Spinner halves 20 are molded of a suitable thermoplastic resinous material, such as polyethylene, to provide the desired light weight, strength and resiliency, each half 20 having a relatively thin wall 21 formed with a thickened peripheral rim 22, a hub 23 and a plurality of radially extending ribs 24 formed on the interior or concave surface of wall 21, shown in FIG. 5 as four in number symmetrically spaced in 90° relation to each other and extending between hub 23 and rim 22.

Figure 3:
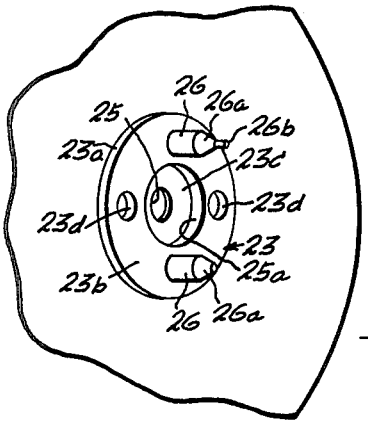
FIG. 3 is an enlarged fragmentary perspective view of the abutment side of the hub portion of one of the identical bowl-shaped halves of the spinner shown in FIG. 2 prior to assembly showing details of the aligning pins and openings.

Hub 23 is seen in FIGS. 2 and 3 to include an annular portion having a thickness for projecting from the exterior or convex surface of wall 21 to provide an annular shoulder **23*a* and a flat annular abutment surface 23*b*. Axial opening 25 extends through the center of hub 23 and is surrounded by a relatively thin annular web 23*c* which is recessed from surface 23*b* providing an enlarged bore 25*a* and projects from the interior convex surface of wall 21. Each annular web 23*c*, in addition to this location on hub 23, is also diametrically proportioned to seat either the head 16*a* of bolt 16 or nut 17 thereagainst when held together thereby in the assembly of halves 20 on bolt 16 and provide resiliency for preventing breakage of halves 20** in the manner hereinafter more fully described.

A pair of pins 26 are integrally formed in diametrical alignment with each other to project from abutment surface **23*b* and a pair of openings 23*d* are formed in diametrical alignment to extend through hub 23 in angular registering relation to pins 26, herein shows as 90°, for engaging with similar pins 26 of the other half 20 when assembled therewith as seen in FIG. 2. Pins 26 each have a length in excess of the thickness of hub 23 at openings 23*d* so that a tapered, that is, a conical shaped end portion 26*a* will project from opening 23*d* when halves 20 are in assembly as shown in FIG. 2. The conical shaped end portions 26*a* cooperate with the resiliency of webs 23*c* in the manner hereinafter described in reference to FIG. 4. For purpose of indexing, one of the pins 26 on each of the molded halves 20 may be formed with an axial projection 26*b* extending from the apex of the conical end portion 26*a***.

The practical utility and operation of diabolo toy 10 with the self balancing spinner 15 will now be apparent. Spinner 15 is readily assembled by bringing hubs 23 of bowl-shaped halves 20 face-to-face and aligning pins 26 of each hub 23 with the openings **23*d* of the other hub 23 whereby pins 26 will enter into and extend through openings 23*d* bringing hub surfaces 23*b* into abutment. Bolt 16 is then inserted through axial openings 25 and nut 17 threaded thereon and finger tightened providing the assembly shown in FIG. 2. With hub surfaces 23*b* retained in abutment by bolt 16 and nut 17, annular shoulders 23*a* of hubs 23 coact to provide a closed bottom for the medial, relatively deep, annular groove of spinner 15 formed by the exterior convex surfaces of walls 21, which bottom is of sufficient width to accommodate free engagement by string 11 therewith for rotating spinner 15**.

As the first step in playing with toy 10, spinner 15 is placed on string 11 which passes beneath and engages the bottom of the medial annular groove. As shown in FIG. 1, string 11 is disposed in a V-shaped configuration for accommodating spinner 15 at the bottom thereof, preferably by holding handles 12 waist high and spaced in parallel relation about one foot apart. In this position the self balancing of spinner 15 on string 11 is achieved by the upwardly extending portions of string 11 passing between the relatively narrow and deep portion of the annular groove adjacent shoulders **23*a* created by the convex surfaces of walls 21. As indicated in broken lines in FIG. 2, any tilting of spinner 15 from the horizontal is limited to the relatively small angle a which is insufficient to permit spinner 15 to become unbalanced and tumble off string 11. The relatively short overall length of spinner 15, that is, the spacing of rims 22 from each other which is less than the diameter of rims 22, contributes to the stability of spinner on string 11. This balancing of spinner 15 while at rest on string 11 provides the desired satisfaction at purchase for toy 10. Now, by shaking one of the handles 12 in rhythm vertically up and down just a short distance, which may be accomplished by a wrist movement, spinner 15 will commence spinning on string 11 and in this manner is brought to a sufficient speed of rotation wherein the gyroscopic force provides horizontal stability to spinner 15** for performing the various well known maneuvers of diabolo toys, such as, flying, catching, flipping and playing catch between two or more players.

Figure 4:
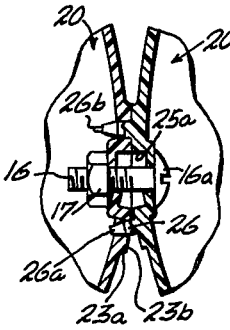
FIG. 4 is a vertical fragmentary view of the hub portion of the spinner in FIG. 2 showing the lower aligning pin sprung from full engagement with the opening as when the hub separate due to impact of the rims with a hard surface.

Playing with diabolo toy 10 involves tossing spinner 15 into the air which, when not caught properly on string 11, may fall to the ground with sufficient impact to crack the walls 21 or otherwise damage the spinner were it not for the flexibility provided by webs **23*c* and tapered ends 26*a* of pins 26. When striking the ground, rims 22 at the points of impact are forced apart, which stress is transmitted to hubs 23 and absorbed and dissipated by the flexure thereof which is illustrated in FIG. 4 as the separation of the bottom portion of hubs 23. This separation is made possible by the flexibility of webs 23***c* which are flexed into the space therebetween provided by enlarged bores 25*a*. As hubs 23 flex and separate, the pin located in the region of separation of hubs 23 is partially withdrawn through opening 23*d*. The conical end portion 26*a* of pin 26 readily permits this withdrawal without undue stress and shearing force being exerted to distort or break off pin 26 while simultaneously increasing the effective length thereof for insuring proper reentering of pin 26 into opening 23*d* thus facilitating the return of hubs 23 and shoulders 23*a* to abutment relation and closing the bottom of the medial annular groove for free engagement by string 11.

It is contemplated within the scope of the invention that pins 26 and openings 23*d* may be fewer or more than two in number and may be positioned other than diametrically, as for example, the pair of pins 26 may be located at right angles to each other to engage openings 23*d* correspondingly arranged. Also, hubs 23 may be fashioned as male and female so that one of the halves 20 has a hub bearing only the pins and the other half 20 has a hub bearing only the openings.

Figure 6:
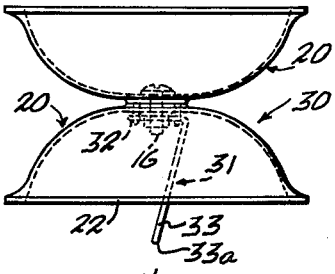
FIG. 6 is an elevational view of the spinner modified with a ground engaging support bracket positioned for spinning on a vertical axis.
Figure 7:
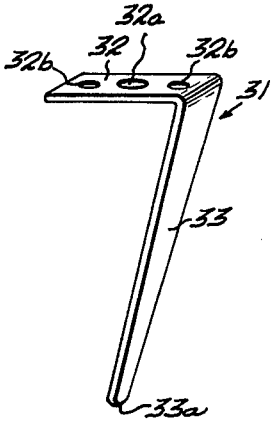
FIG. 7 is an enlarged perspective view of the support bracket removed from the spinner shown in FIG. 6.

FIG. 6 shows spinner 15 modified as a ground supported vertical axis spinning top 30 by the attachment of ground engaging support bracket 31 by bolt 16 and nut 17 to the hub assembly. As seem in FIG. 7, bracket 31 comprises a flat mounting plate 32 and a tapered stem 33 extending from one end thereof at an angle slightly less than 90° to locate the rounded ground engaging end 33*a* thereof on the axial extension of bolt 16 beyond the plane of rim 22. Mounting plate 32 is formed with a central opening 23*a* sized to pass bolt 16 therethrough and a pair of aligned smaller openings 32*b*, one on either side of central opening 32*a*, located to engagingly accommodate the conical end portions 26*a* projecting from openings 23*d*. While bracket 31 is shown in a preferred form with a single stem 33 for maximum resiliency, such bracket may be symmetrically formed to have a stem extending from each end of plate 32 as a pair of arms merging at the bottom ends thereof to form a suitable ground engaging tip.

The conversion of spinner 15 to the vertical axis spinning top 30 is readily accomplished by removing nut 17, slipping bolt 16 through opening 32*a* so that plate 32 of bracket 31 lies flat against the interior surface of hub 23 and is orientated for projection of conical end portions 26*a* into smaller openings 32*b*, and then replacing nut 17 on bolt 16 to complete the mounting of bracket 31 as shown in broken lines in FIG. 6. By winding a free end of a string around the annular groove of top 30, the latter is then spun in any conventional fashion, and when thrown, the resiliency of stem 33 provides a lively bounce to the toy. Also, the string may be used to whip the spinning top 30 to renew its rotational speed and caused further bouncing.

Spinner 15 is also adaptable to serve as two additional toys, namely, as a large size Yo-Yo by securing a free end of a string in the annular groove, as for example, by means of a slip knot and loop, and as two frisbees which are provided by halves 20 when disassembled by removal of nut 17 and bolt 16.

The diabolo top spinner constructed of bowl-shaped halves self balancing characteristics, the attachable bracket for conversion to a vertical axis spinning top, and the adaptability of the spinner as a Yo-Yo and the halves as frisbees as herein disclosed are seen to achieve the several objects of the invention and to be well adapted to meet conditions of practical use. As various possible embodiments might be made of this invention, and as various changes might be made in the disclosed constructions, it is to be understood that all matters herein set forth and shown in the accompanying drawing are to be interpreted as illustrative and not in a limiting sense.

What is claimed is:

1. A spinner for a string manipulated diabolo toy having characteristics for self balancing on the string preparatory to spinning, comprising bowl-shaped halves having smooth convex exterior wall surfaces defining a medial relatively deep annular groove therebetween for engaging said string therein, said groove having a bottom along which said string engagingly extends and sidwalls formed by said convex exterior wall surfaces, said groove sidewalls being in relative close proximity to each other along a substantial radial distance from the bottom of the groove to engage said string and limit the angle of tilt of said spinner when at rest as said self balancing characteristic.

2. The spinner defined in claim 1 in which the overall horizontal axial length thereof is less than the diameter of the bowl-shaped halves.

3. The spinner defined in claim 1 in which each of the bowl-shaped halves comprises a plastic molded unit having a hub formed with a flat exterior surface, an axial opening and coacting aligning pin means, a bolt extending through said axial opening, a nut, finger tightened on said bolt, retaining said hub flat exterior surfaces in face-to-face abutment with said coacting aligning pin means in operative position, each of said hubs being formed with an annular shoulder at the periphery of said flat exterior surface, said shoulders cooperarting to form said bottom of the annular groove when said flat exterior surfaces are in said abutment.

4. The spinner defined in claim 3 in which each of said bowl-shaped halves is formed with a thickened peripheral rim, and resilient means associated with said hubs permitting portions of said flat exterior surfaces to separate on flexure of the hubs to absorb the impact of the spinner when falling to the ground on said thickened peripheral rims and thereby avoid breakage.

5. The spinner defined in claim 4 in which said resilient means of each of said hubs includes an enlarged bore for said axial opening extending inwardly from said flat exterior surface and terminating at a flexible annular web formed at an interior surface of the hub, said bolt having a head engaging the flexible annular web of one hub and said nut engaging the flexible web of the other hub in said face-to-face abutment retention of said hub exterior surfaces, portions of each of said webs flexing into said enlarged bores on said ground impact.

6. The spinner defined in claim 4 in which said coacting aligning pin means include a pin extending from one of said hub exterior surfaces engaging an opening in the other hub, said pin terminating in a conical shaped end for coacting with said resilient means to facilitate said hub flexure and partial exterior surface separation and provide for rapid return of the hub exterior surfaces to abutment relation after impact restore a closed bottom for said annular groove.

7. The spinner defined in claim 3 in which said molded units each has a peripheral rim, a bracket for converting the spinner to a vertical axis spinning ground engaging top, said bracket having plate means for removable mounting against one of said hubs by said bolt and nut and a stem extending from said plate means terminating in a ground engaging tip located beyond the corresponding peripheral rim on an axial extension of said bolt.

8. The spinner defined in claim 7 in which said stem has resiliency providing bounce to the top when spinning on the ground.

9. The spinner defined in claim 3, in combination with a string having one end attached to said annular groove bottom whereby the spinner and string provide a large size Yo-Yo.

10. The spinner defined in claim 3 in which said bowl-shaped molded units are separable by disengagement of the nut and bolt to serve independently of each other as frisbees and capable of reassembly by said nut and bolt as said diabolo spinner.

11. The spinner defined in claim 1 in which each of the bowl-shaped halves is an identical plastic molded unit having a hub formed with a flat exterior surface and an axial opening, a plurality of pins integrally formed in spaced relation extending at right angles to said exterior surface and a plurality of openings formed in said hub in registered alignment to engage the pins of the other identical molded unit when axially arranged in assembly with said hub exterior surfaces in face-to-face abutment relation, and bolt means extending through said axial openings retaining said molded units in assembly.

* * * * *

UNITED STATES PATENT AND TRADEMARK OFFICE

CERTIFICATE OF CORRECTION

PATENT NO. : 4,194,316

DATED : March 25, 1980

INVENTOR(S) : Walter L. Jordan

It is certified that error appears in the above—identified patent and that said Letters Patent is hereby corrected as shown below:

On the title page, Item [76], "Walter L. Jordon" should read --- Walter L. Jordan ---.

Signed and Sealed this

*Fifteenth* Day of *July 1980*

[SEAL]

*Attest:*

SIDNEY A. DIAMOND

*Attesting Officer*

*Commissioner of Patents and Trademarks*